US011007784B2

(12) United States Patent
Bas et al.

(10) Patent No.: US 11,007,784 B2
(45) Date of Patent: May 18, 2021

(54) PRINTHEAD CLEANING METHODS

(71) Applicant: HEWLETT-PACKARD DEVELOPMENT COMPANY, L.P., Spring, TX (US)

(72) Inventors: Jordi Bas, Sant Cugat del Valles (ES); Alejandro Mielgo, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/616,526

(22) PCT Filed: Jul. 31, 2017

(86) PCT No.: PCT/US2017/044682
§ 371 (c)(1),
(2) Date: Nov. 25, 2019

(87) PCT Pub. No.: WO2019/027421
PCT Pub. Date: Feb. 7, 2019

(65) Prior Publication Data

US 2020/0156378 A1 May 21, 2020

(51) Int. Cl.
*B41J 2/165* (2006.01)

(52) U.S. Cl.
CPC .. *B41J 2/16535* (2013.01); *B41J 2002/16564* (2013.01)

(58) Field of Classification Search
CPC .. B41J 2/1652; B41J 2/16526; B41J 2/16535; B41J 2/16552; B41J 2/16538; B41J 2002/1655; B41J 29/17; B41J 2002/16564; B41J 2/165; B41J 2/16517; B41J 2/16541
See application file for complete search history.

(56) References Cited

U.S. PATENT DOCUMENTS 6,557,971 B1 * 5/2003 Vega et al. ..... B41J 2/1652
7,914,110 B2 3/2011 Curcio et al.
8,465,121 B2 6/2013 Yamada et al.
8,733,888 B2 * 5/2014 Gaston et al.
(Continued)

FOREIGN PATENT DOCUMENTS

EP 1805024 B1 4/2013
WO WO-2016198083 12/2016

OTHER PUBLICATIONS

HP PageWide Technology < http://www.hp.com/hpinfo/newsroom/press_kits/2015/PageWideXL2015/PageWideTechnology.pdf > Dec. 2014 (8 pages).

*Primary Examiner* — Jannelle M Lebron
(74) *Attorney, Agent, or Firm* — HP Inc. Patent Department

(57) ABSTRACT

With the purpose of providing an improved cleaning mechanism that accomplishes better results and that may be used in thermal and piezoelectric printing, it is dis-closed a method for cleaning a printhead comprising: moving a wiper along a plurality of nozzles of the printhead; and pressurizing the nozzles within the printhead, the pressurization of each nozzle causing ink to be expelled in an expelling direction; wherein a controller is to detect the position of the wiper and to selectively pressurize at least some of the nozzles for which the position of the wiper corresponds to its expelling direction.

20 Claims, 6 Drawing Sheets

(56) References Cited

U.S. PATENT DOCUMENTS

| | | | | |
|---|---|---|---|---|
| 2003/0081047 | A1 | 5/2003 | Yearout et al. | |
| 2004/0036735 | A1 | 2/2004 | Garbacz et al. | |
| 2008/0024537 | A1* | 1/2008 | Park | B41J 2/16526 |
| 2016/0297204 | A1 | 10/2016 | Cessel et al. | |
| 2017/0015101 | A1 | 1/2017 | Coma Vives et al. | |

* cited by examiner

PRINTHEAD CLEANING METHODS

BACKGROUND

Inkjet printers are, in general terms, controllable fluid ejection devices that propel droplets of ink from a nozzle to form an image on a substrate wherein such propelling can be achieved by different technologies. In all of such technologies, the primary cause of inkjet printing problems is ink drying on the nozzles, causing the pigments and dyes of the ink to dry out and form a solid block of hardened mass that may clog the ink passageways.

BRIEF DESCRIPTION OF THE DRAWINGS

Examples will now be described, by way of non-limiting example only, with reference to the accompanying drawings, in which.

DETAILED DESCRIPTION

Common fluid ejection technologies are divided into two main categories: fluid ejection through thermal drop generation or piezoelectric drop generation. Piezoelectric drop generation is performed by using a piezo actuator for modifying the pressure of a chamber thereby controlling the expelling of ink through an opening on such chamber and thermal drop generation is accomplished by using a heater to increase the temperature of ink within a chamber thereby generating a bubble that, in turn, increases the internal pressure of a chamber and ejects drops.

In thermal drop generation it is inherently harder to control the pressure inside the chamber whereas on piezoelectric drop generation the actuator can be used to modify the internal pressure more accurately and, furthermore, the pressure can be set to specific values throughout the printing process. Nonetheless piezoelectric drop generation is much more expensive and technically complex than thermal drop generation. A cleaning method that may be used for, at least, both piezoelectric and thermal drop generation printing systems would be advantageous.

As mentioned above, hereby it is disclosed a cleaning mechanism allows to prevent clogging of the nozzles within a printhead. The cleaning mechanism allows to clean printheads irrespective of whether the drop generation is performed thermally or by piezoelectric means and, also, a method is disclosed wherein it is prevented that air may flow through the nozzle into the printhead and may help prevent the generation of air bubbles in the nozzle.

Figure 1:
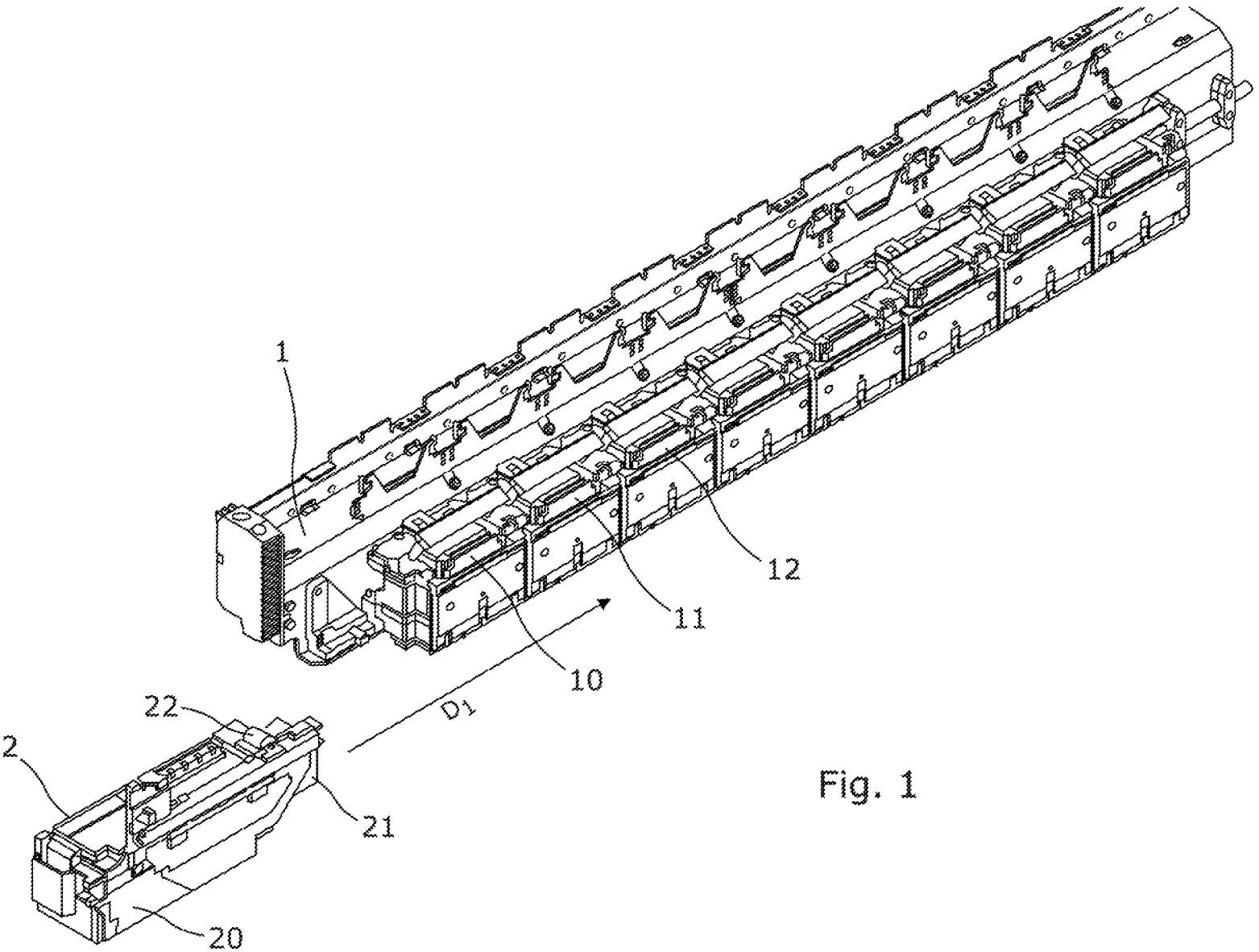
FIG. 1 shows a perspective view of an example of a printhead and a cleaning mechanism.

FIG. 1 shows an example of a printhead carriage 1 that comprises a set of receptacles to receive printheads 10, 11, 12. Each of such printheads 10, 11, 12 comprises an inner container with printing fluid and a set of nozzles to controllably expel such printing fluid through the nozzle in an expelling direction as to generate an image on a substrate located in such expelling direction.

As mentioned above, the expelling of the printing fluid through the nozzles is performed by pressurizing a firing chamber within the printhead upstream of the nozzles, such firing chamber comprising a determined amount of printing fluid. This pressurization causes the ejection of droplets of the printing fluid thought the nozzle and may be performed, e.g., by using a piezo actuator or a heater. In the case of the piezo actuator, the pressure of the firing chamber can be controlled to several values since the vibration of such piezo actuator may be controlled by a control signal issued by a controller. On the other hand, in the case of heaters, the printing system is either pressurized (with the heater activating generating bubbles on the printing fluid) or non-pressurized (with the heater being deactivated) with no intermediate pressurization.

To clean the nozzles of the printheads 10, 11, 12 it is envisaged using a cleaning mechanism 2 comprising a wiper 22 attached to a wiper carriage 20 being such wiper carriage 20 movable along the printhead carriage 1. In particular, the wiper carriage 20 is to move below the printhead carriage while contacting the nozzles as to provide a rubbing effect. The movement of the cleaning system is, in an example, performed in a cleaning direction Di.

Figure 2:
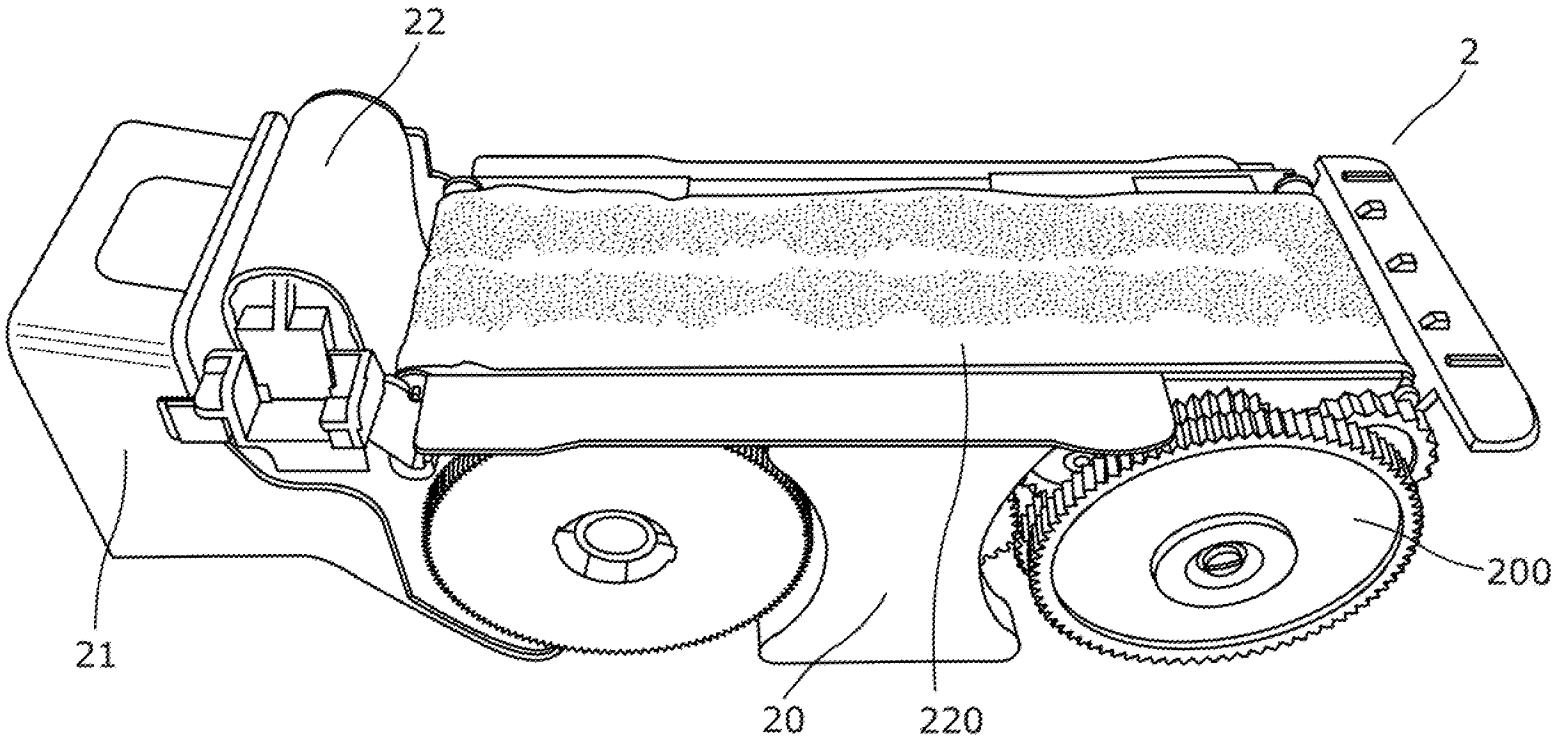
FIG. 2 is a perspective view of an example of a cleaner.

FIG. 2 shows an example of cleaning mechanism 2 according to an example. The cleaning mechanism 2 of FIG. 2 comprises a wiper carriage 20, a wiper container 21, a wiper 22 at least one toothed wheel 200.

The wiper 22 may comprise an absorbent such as, e.g., a cloth or foam to withdraw printing fluid residues that may located on the nozzle and/or its surroundings. Further, the cleaning mechanism 2 may comprise or be connected to a motor for moving the cleaning mechanism 2 at least linearly along the printhead carriage 1. Such motor may, for example, be connected to a belt that engages the toothed wheels 200 as to move the cleaning mechanism. Furthermore, the cleaning mechanism may comprise or be connected to at least one position sensor such as, e.g., a laser distance sensor, an optical encoder and/or a mechanical encoder. In an example, the cleaning mechanism comprises a laser distance sensor and is connected additionally to a mechanical encoder attached to the belt thereby achieving an improved accuracy.

Furthermore, the cleaning mechanism 2 may comprise an elastic member 23 located below at least a section of the wiper 22. The effect achieved by such elastic member 23 is to perform a rubbing force in a direction with a component in a direction perpendicular to the wiper, i.e., in the direction towards the nozzles and/or with a component a direction opposed to the firing direction of the nozzles. Examples of this elastic elements may be foam and/or rubber. In an example, the wiper 22 and the elastic member 23 may be a single element.

To perform the cleaning, the cleaning mechanism 2 may comprise consumables that may be replaced during the lifetime of the cleaning mechanism 2. For example, the wiper 22 may be a cloth that may comprise the wiper container 21 for clean cloth and a storage for used cloth 220.

Figure 3:
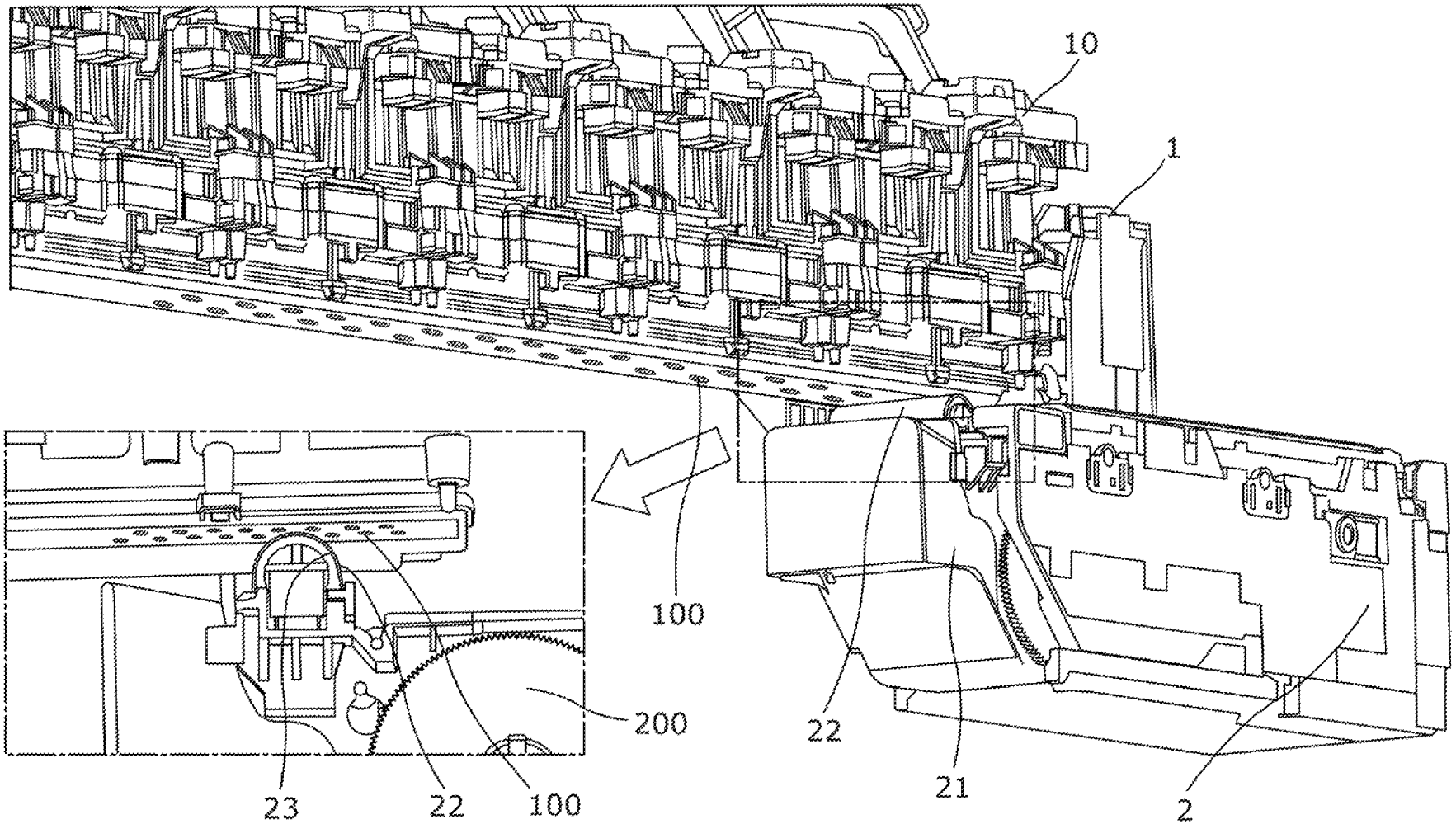
FIG. 3 shows a detailed view of an example cleaner acting on a printhead.

Referring now to FIG. 3 a perspective view is shown of the cleaning mechanism 2 as it moves along the printhead carriage 1 carrying at least one printhead 10. Also, it is shown a detailed of a longitudinal section showing the interaction between the cleaning mechanism 2 and a set of nozzles 100.

In FIG. 3 it can be seen that the cleaning system is to move in a cleaning direction Di. In an example, the cleaning direction Di is a direction along a linear trajectory following a bidirectional movement longitudinally along the printhead 1 and, in a further example, the wiper 22 has a width enough to cover transversally at least the width of the printhead comprising nozzles. In this manner, a single pass of the cleaning system in the cleaning direction Di may clean all the nozzles 100 within the printhead 1.

In an example, the cleaning system comprises a wiper 22 and at least a portion of such wiper 22 is located over an elastic member 23. This configuration helps to perform a force with a component in a direction perpendicular to the cleaning direction Di as to exert a force towards the nozzle 100 providing a rubbing action between the wiper 22 and the nozzle 100.

Figure 4A:
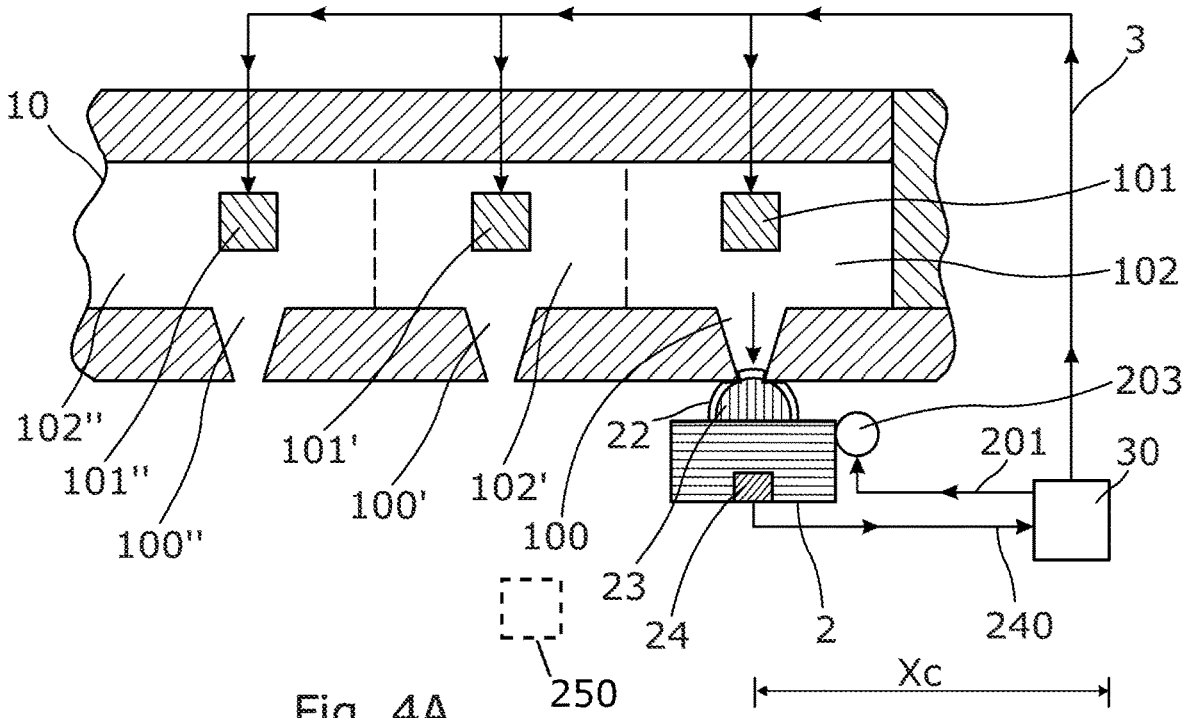
FIG. 4A is a schematic view of a set of nozzles and an example of a cleaning mechanism in a first position.
Figure 4B:
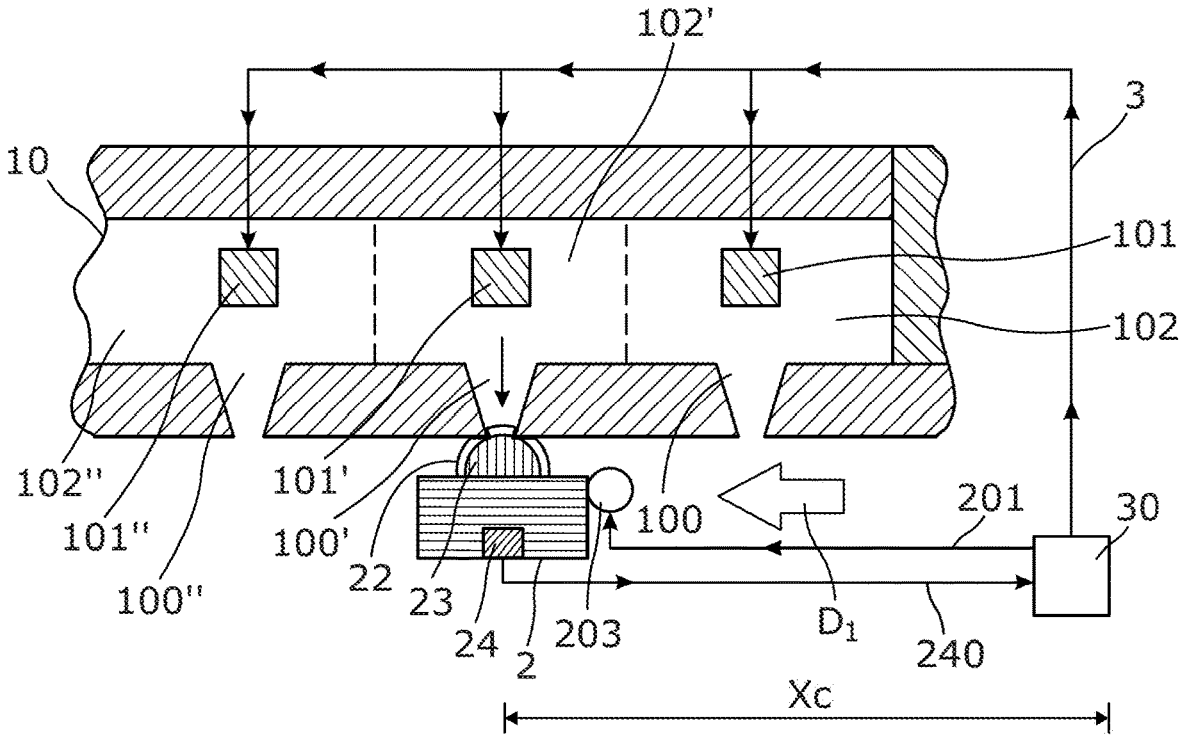
FIG. 4B is a schematic view of the set of nozzles and the cleaning mechanism of FIG. 4A with the cleaning mechanism in a second position.

FIGS. 4A and 4B are a schematic longitudinal section illustrating a cleaning action performed by an example of cleaning mechanism 2. In a first cleaning position, as shown in FIG. 4A, the cleaning mechanism 2 is moved by a motor 203 and instructed by a controller 30 by means of a movement signal 201 to be positioned at a determined distance for a reference point. The controller 30 determines that the actual position Xc of the cleaning mechanism 2 corresponds to the position of a first nozzle 100, e.g., by receiving a positioning signal 240 from an encoder 24. Once it has been determined that the actual position Xc corresponds to a first nozzle 100, the controller 30 issues a control signal 3 towards a first actuator 101 that increases the pressure of a first firing chamber 102 thereby expelling printing fluid located within the chamber through the first nozzle 100. In an example, the controller 30 only issues the firing signal to the first actuator 101 so that a second actuator 101' and a third actuator 101" are not energized and printing fluid is not expelled to their respective second nozzle 100' and third nozzle 100".

The expelling action while the cleaning mechanism is located in the expelling direction of the nozzle accomplishes two main objectives. First, it removes any blockage that may be located within the nozzle preventing a proper expelling of fluid and, second, it prevents air bubbles to be generated within the nozzle given that there is a fluid pressure to the outside of the nozzle 100.

Referring now to FIG. 4B, the cleaning mechanism 2 has moved along a cleaning direction Di from below the first nozzle to a position wherein the wiper 22 is located in the expelling direction of the second nozzle 100'. In this actual position Xc the controller determines which nozzles have a expelling direction towards the actual position Xc of the cleaning mechanism 2. In the example of FIG. 4B, only the second nozzle 100' has a expelling direction towards the wiper 22 and, therefore, the controller issues a control signal 3 so that the second actuator 101' pressurizes the second firing chamber 102' thereby expelling printing fluid through the second nozzle 100' while maintaining the actuators that correspond to the nozzles for which the expelling directions are not towards the actual position Xc of the wiper 22 inactivated, i.e., maintain its firing chambers at a pressure wherein there is no expelling of fluid through the nozzle.

In the particular example of FIG. 4B the first actuator 101 and a third actuator 101" have nozzles which expelling directions are not towards the wiper 22 of the cleaning mechanism 2. Therefore, the first actuator 101 and the third actuator 101" are inactive. In the case of piezo electric actuators, the actuators do not vibrate or, at least, do not vibrate with a frequency and/or amplitude enough to cause fluid to be expelled through the nozzle and, in the case of thermal actuators, the nozzles are not heated, or, at least, not heated at a temperature enough to cause bubbles within the firing chamber. On the other hand, the second actuator 101' is activated thereby expelling fluid through the second nozzle 100'.

As for the encoder 24, the cleaning mechanism 2 may comprise an internal encoder or it may be external to the cleaning mechanism 2, e.g., an encoder attached to a belt that is to move the cleaning mechanism 2. In alternative embodiments an optical system including an optical sensor 250 (FIG. 4A) may be used to determine the position of the cleaning mechanism or even several positioning mechanisms may be used in order to improve the accuracy of the positioning signal 240.

In the example of FIGS. 4A and 4B it can be seen that a synchronization to activate the actuators associated to nozzles which expelling direction correspond to the position of the cleaning mechanism is advantageous for the health of the nozzles. Also, maintaining inactive the actuators for which the cleaning mechanism 2 (or the wiper 22) is not on its expelling direction helps optimize the use of ink and maintain clean other parts of the printing system.

Figure 5:
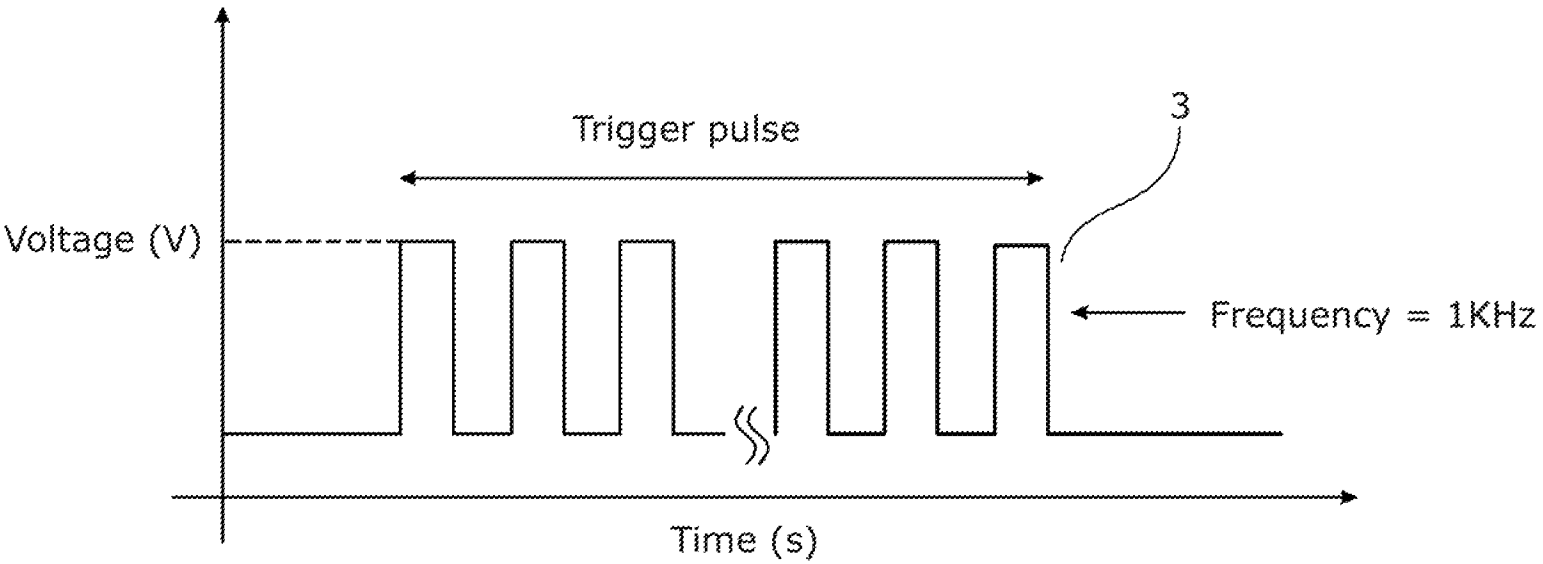
FIG. 5 is an example of control signal send to the nozzles.

FIG. 5 shows an example of control signal 3 issued by the controller 30 to activate the actuators. The control signal is preferably a low frequency signal. In the example of FIG. 5, the frequency of the signal is 1 kHz, however, it is envisaged the use of any frequency in a range between 500 Hz and 1500 Hz.

The control signal 3 of FIG. 5 is an example of trigger pulse to be used with a thermal actuator for a predetermined time or may be configured to be maintained until the wiper 22 is not in the expelling direction of the nozzle.

Figure 6:
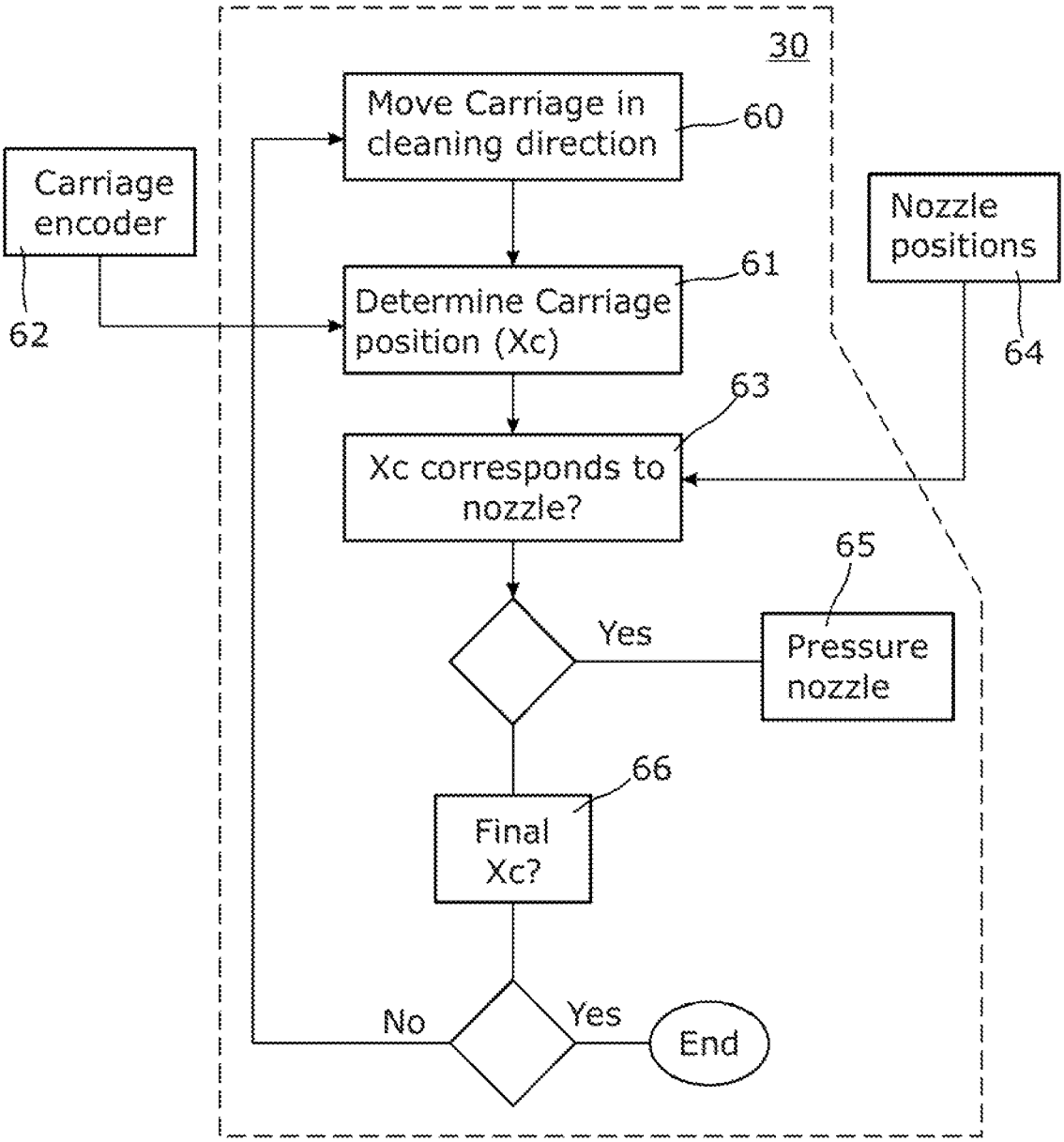
FIG. 6 is a flow diagram of a printhead cleaning method according to an example.

FIG. 6 shows a flow diagram further explaining the cleaning process according to an example.

In the example of FIG. 6 the controller 30 is to receive a signal from a carriage encoder 62 or any positioning device associated to the cleaning carriage and, also, to receive the positions wherein nozzles are located. The nozzle positions 64 may be, e.g., obtained from a database.

The controller 30 is to control the movement of the carriage 60 in a cleaning direction, i.e., longitudinally along the printhead carriage 1. By means of the carriage encoder 62, the controller determines the carriage position Xc 61, then, the controller 30 runs a comparing action 63 as to determine if the actual position Xc of the carriage corresponds to a expelling direction of at least a nozzle. If there is at least a nozzle that fulfils such condition, the controller sends a control signal as to pressurize the nozzles 65 that comply the condition. Even though, in the example of FIGS. 4A and 4B only one nozzle was activated at a time, in the example of FIG. 6 it can be seen that several nozzles may fulfil the condition of having its expelling direction towards the wiper 22, i.e., having the wiper below them or in contact with them.

Finally, the controller 30 checks if the cleaning carriage is at its final position 66. If it is, then the cleaning is finished and, if it is not the movement of the carriage is continued.

In essence, it is disclosed a method for cleaning a printhead comprising:

moving a wiper along a plurality of nozzles of the printhead; and pressurizing the nozzles within the printhead, the pressurization of each nozzle causing ink to be expelled in an expelling direction;

wherein a controller is to detect the position of the wiper and to selectively pressurize at least some of the nozzles for which the position of the wiper corresponds to its expelling direction.

In an example, the wiper is to move along the plurality of nozzles exerting a rubbing action on the plurality of nozzles. This is performed by having, e.g., an elastic element below or forming part of the wiper.

In a further example, the wiper comprises an ink absorbing element, e.g., a cloth or a foam.

The pressurization of the nozzles may be performed, in the case of a thermal drop generation by activating a heater in the vicinity of the nozzle or associated to such nozzle.

Furthermore, the controller may be to detect the position of the wiper by receiving a position signal from an encoder, an optical sensor, a laser or any other type of positioning mechanism associated to the cleaning carriage.

As for the expelling of printing fluid, the pressurization of the nozzles may be done at a frequency in the range of 500 Hz to 1500 Hz, for example at 1 kHz.

Also, it is disclosed a printing system comprising:

a printhead receptacle adapted to receive a printhead, wherein the printhead contains ink comprises a plurality of nozzles as to expel ink in an expelling direction;

a carriage adapted to receive a wiper; and an encoder to determine the position of the carriage wherein the printing system comprises a controller to move the carriage along the plurality of nozzles and to issue a control signal as to selectively expel ink through a nozzle when the wiper is located in its expelling direction.

In an example, the wiper comprises an elastic member as to perform a rubbing action on the nozzles.

Furthermore, the system may comprise an encoder or an optical detector to determine the position of the carriage.

In a further example, the printhead comprises heaters on the plurality of nozzles and the control signal to selectively expel ink through a nozzle is an electric signal that activates such heaters.

Furthermore, the carriage may comprise an optical drop detector.

The invention claimed is:

1. A method for cleaning a printhead, comprising:

moving a wiper along a plurality of nozzles of the printhead;

detecting, by a controller, that the wiper is at a first position at which the wiper is engaged with a first nozzle of the plurality of nozzles; and in response to detecting that the wiper is at the first position, selectively pressurizing the first nozzle while the wiper is engaged with the first nozzle, the selective pressurizing of the first nozzle causing expelling of a printing fluid in an expelling direction towards the wiper that is engaged with the first nozzle.

2. The method of claim 1, wherein the wiper moves along the plurality of nozzles while exerting a rubbing action on the plurality of nozzles.

3. The method of claim 1, wherein the wiper comprises a printing fluid absorbing element.

4. The method of claim 3, wherein the printing fluid absorbing element comprises a cloth.

5. The method of claim 1, wherein the selective pressurizing of the first nozzle is performed by activating a heater in a vicinity of the first nozzle.

6. The method of claim 1, wherein the controller detects the first position of the wiper based on receiving a position signal from an encoder.

7. The method of claim 1, wherein the controller detects the first position of the wiper based on receiving a position signal from an optical position sensor.

8. The method of claim 1, wherein the wiper is moved by a carriage.

9. The method of claim 8, wherein the selective pressurizing of the first nozzle is done at a frequency in a range of 500 Hz to 1500 Hz.

10. The method of claim 1, comprising:

in response to detecting that the wiper is at the first position, maintaining, by the controller, a second nozzle of the plurality of nozzles inactive so that the second nozzle does not expel the printing fluid.

11. The method of claim 10, wherein the controller maintains the second nozzle inactive responsive to the wiper not being engaged with the second nozzle while the wiper is engaged with the first nozzle.

12. The method of claim 10, wherein the selective pressurizing of the first nozzle is based on the controller sending a control signal to a first actuator of the first nozzle, and wherein maintaining the second nozzle inactive is based on maintaining a second actuator of the second nozzle inactive.

13. A printing system comprising:

a printhead receptacle to receive a printhead that comprises a plurality of nozzles to expel a printing fluid in an expelling direction;

a carriage to receive a wiper; and a controller to, control movement of the carriage to move the wiper along the plurality of nozzles, detect that the wiper is at a first position at which the wiper is engaged with a first nozzle of the plurality of nozzles, and in response to detecting that the wiper is at the first position, cause selective pressurization of the first nozzle while the wiper is engaged with the first nozzle, the selective pressurization of the first nozzle causing expelling of the printing fluid in the expelling direction through the first nozzle towards the wiper that is engaged with the first nozzle.

14. The printing system of claim 13, wherein the wiper comprises an elastic member to apply a rubbing force by the wiper on the first nozzle.

15. The printing system of claim 13, comprising an optical detector to measure a position of the carriage.

16. The printing system of claim 13, wherein the printhead comprises heaters in the plurality of nozzles, and the controller is to output a control signal to a heater of the heaters to selectively expel the printing fluid through the first nozzle.

17. The printing system of claim 16, wherein the control signal is in a frequency range between 500 Hz and 1500 Hz.

18. The printing system of claim 13, wherein the controller is to:

in response to detecting that the wiper is at the first position, maintain a second nozzle of the plurality of nozzles inactive so that the second nozzle does not expel the printing fluid.

19. The printing system of claim 18, wherein the controller is to maintain the second nozzle inactive responsive to the wiper not being engaged with the second nozzle while the wiper is engaged with the first nozzle.

20. The printing system of claim 18, wherein the controller is to send a control signal to a first actuator of the first nozzle to perform the selective pressurization of the first nozzle, and the controller is to maintain the second nozzle inactive by maintaining a second actuator of the second nozzle inactive.

* * * * *